United States Patent [19]

Johnson et al.

[11] Patent Number: 4,475,511

[45] Date of Patent: Oct. 9, 1984

[54] FUEL DISTRIBUTION CONTROL SYSTEM FOR AN INTERNAL COMBUSTION ENGINE

[75] Inventors: Edwin A. Johnson, Clarkston; Chun K. Leung, Bloomfield Hills, both of Mich.

[73] Assignee: The Bendix Corporation, Southfield, Mich.

[21] Appl. No.: 413,919

[22] Filed: Sep. 1, 1982

[51] Int. Cl.[3] ..... F02D 5/00

[52] U.S. Cl. ..... 123/436

[58] Field of Search ..... 123/419, 436, 478

[56] References Cited

U.S. PATENT DOCUMENTS

| | | | |
|---|---|---|---|
| 4,197,767 | 4/1980 | Leung | 74/80 |
| 4,357,662 | 11/1982 | Schira et al. | 364/431.08 |
| 4,375,668 | 3/1983 | Leung et al. | 123/419 X |
| 4,418,669 | 12/1983 | Johnson et al. | 123/436 |

OTHER PUBLICATIONS

"Research Disclosure", Apr. 1979, No. 18002.

*Primary Examiner*—Tony M. Argenbright

*Attorney, Agent, or Firm*—James R. Ignatowski; Russel C. Wells

[57] ABSTRACT

A fuel distribution control for the fuel control system of an internal combustion engine having a fuel control computer generating fuel delivery signals indicative of the engines fuel requirements, means for delivering fuel to the engine in response to said fuel delivery signals and means for generating amplitude signals indicative of the magnitudes of the torque impulses generated by the individual cylinders, the fuel distribution control comprising means for correcting the amplitude signals as a function of the cylinders position along the engine's crankshaft and engine speed, means for generating an average amplitude signal for each cylinder, means for generating an individual difference signal for each cylinder indicative of the difference between the average amplitude signal for the individual cylinders and the average amplitude of all the cylinders, means for generating a fuel correction for each individual cylinder from said difference signals, and means for summing the fuel correction signal with the fuel delivery to generate a corrected fuel delivery signal operative to equalize the contribution of each cylinder to the total output torque of the engine.

22 Claims, 5 Drawing Figures

FUEL DISTRIBUTION CONTROL SYSTEM FOR AN INTERNAL COMBUSTION ENGINE

CROSS REFERENCE

The invention is related to commonly assigned copending U.S. patent application Ser. No. 187,400 "Closed Loop Timing and Fuel Distribution Controls" filed Sept. 15, 1980, now U.S. Pat. No. 4,357,662, which is a continuation of U.S. patent application Ser. No. 904,131 filed May 8, 1978, now abandoned, and U.S. patent application Ser. No. 399,538 "Phase Angle Detector" filed July 19, 1982.

FIELD OF THE INVENTION

The invention is related to the field of internal combustion engine fuel controls and in particular to a control for correcting the quantity of fuel to be delivered to each engine cylinder to equalize the torque contribution of each cylinder to the total torque output of the engine.

PRIOR ART

Electronic ignition and fuel control systems for internal combustion engines are finding acceptance in automotive and allied industries as a result of substantial increases in fuel costs and pollution standards imposed by the government.

R. W. Randall and J. D. Powell of Stanford University in their research under a Department of Transportation sponsored project determined that for maximum efficiency of an internal combustion engine, the spark timing should be adjusted to provided a maximum cylinder pressure at a predetermined crankshaft angle past the piston's top dead center position. The results of this investigation are published in Final Report No. SU-DAAR-503 entitled "Closed Loop Control of Internal Combustion Engine Efficiency and Exhaust Emission". This report contains a block diagram of a closed loop system incorporating a circuit which detects the crankshaft angle at which peak pressure occurs then compares this angle with the predetermined angle to generate an error signal. This error signal is then used to correct the ignition timing signal generated in response to other sensed engine parameters as is known in the art.

C. K. Leung and R. W. Seitz in commonly assigned pending U.S. patent application Ser. No. 187,400 filed Sept. 15, 1980 discloses an alternate closed loop engine timing control which computes the phase angle of the torque impulse applied to the engine's output shaft by the individual pistons. The method for calculating the phase angle of the torque impulse in this patent application is based on the theory that the phase angle of the torque impulse is indicative of the angle at which maximum cylinder pressure occurs. This patent application further discloses a fuel distribution system directed to equalizing the torque contribution of each cylinder to the total torque output of the engine. In the dissolved system the magnitude the torque impulses by each cylinder is computed from the instantaneous rotational velocity of the engine's crankshaft and compared with an average torque value to generate a correction signal. The correction signal is then used to correct the quantity of fuel being delivered to each cylinder.

In addition to the torque applied to the engine's crankshaft from the burning of the fuel in the individual cylinders, other factors, such as the position of the cylinder along the crankshaft and torsional vibrations will affect the instantaneous rotational velocity of the crankshaft and introduce errors into the computation of the magnitude the individual torque impulses. The prior art fuel distribution control systems provided no means for removing these errors from the computed magnitude of the torque impulses.

SUMMARY OF THE INVENTION

The invention is a fuel distribution control for an internal combustion engine having a fuel control computer generating fuel delivery signals indicative of the quantity of fuel to be delivered in response to operational parameters of the engine, means for delivering fuel to the engine in response to the fuel delivery signals and means for computing the amplitude of the torque impulse produced by the individual cylinders in response to the instantaneous rotational velocity of the engine's crankshaft. The fuel distribution control comprises means responsive to the rotational velocity of the engine and the rotational position of the engine's crankshaft for correcting the computed amplitude of the torque impulse produced by each cylinder, an averaging circuit for producing an average value for the corrected amplitudes of the torque impulses produced by each cylinder, integrator means for generating a difference signal indicative of the difference between the average amplitudes of the individual cylinder and the average amplitude of all the cylinders, means for averaging the difference signals, means for subtracting an averaged difference signal from the individual difference signals to generate a correction signal and means for summing the correction signal with the fuel deliver signal to change the quantity of fuel delivered to each cylinder tending to equalize the amplitude of the torque impulse produced by each cylinder.

The advantage of the invention is that the quantity of fuel to each cylinder is individually corrected to equalize the contribution of each cylinder to the total torque output of the engine including piston position and torque vibration. These and other advantages of the control will become apparent from reading the detailed description of the invention in conjunction with the appended drawings.

DETAILED DESCRIPTION OF THE INVENTION

Figure 1:
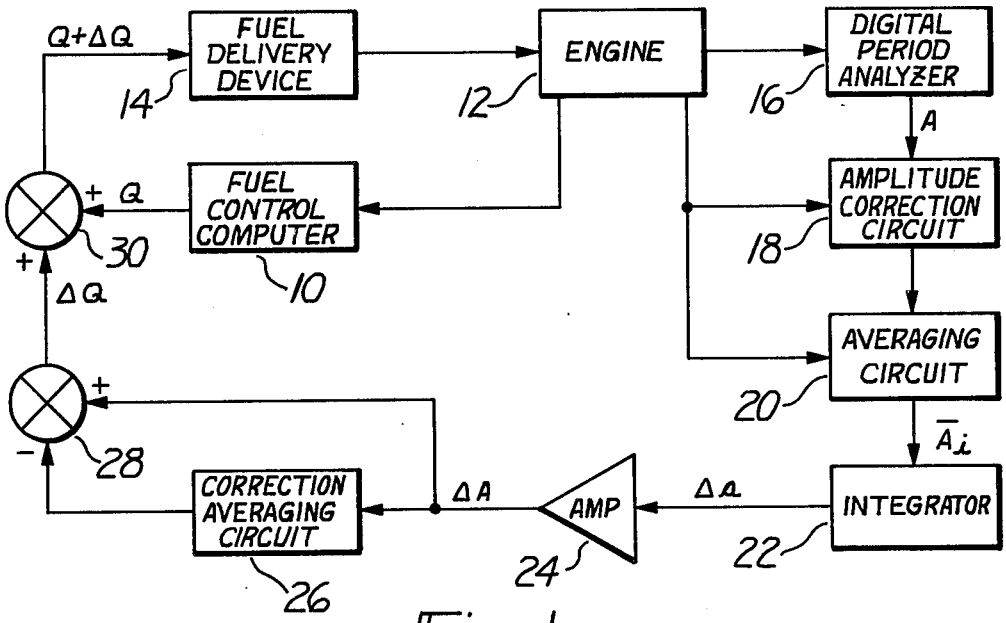
FIG. 1 is a block diagram of the fuel control system embodying the fuel distribution control.

Referring to FIG. 1, there is shown a block diagram of a fuel control system for an internal combustion engine having a fuel control computer 10 generating fuel delivery signals Q indicative of the engine's fuel requirements in response to the operational parameters of an internal combustion engine 12. A fuel delivery device 14 receiving fuel from an external source (not shown) delivers the required quantity of fuel to the engine 12 in response to the fuel delivery signals Q. The fuel delivery device 14 may be of any type known in the art, such as a separate fuel injector for each engine cylinder, a single fuel injector (unit injector) for all of the engine's cylinders, or an electronically controlled carburetor. A means, such as Digital Period Analyzer 16 generates an amplitude signal A indicative of the magnitude of each torque impulse produced by the individual engine cylinders in response to the instantaneous rotational velocity of the engine's crankshaft. An Amplitude Correction Circuit 18 responsive to the engine speed and rotational position of the engine's crankshaft and corrects on a cylinder by cylinder basis the amplitude signal A received from the Digital Period Analyzer 16. The corrected amplitude signals are then averaged for each cylinder in Averaging Circuit 20 to produce an individual average amplitude signal $\overline{A}$ for the torque impulses produced by each cylinder. An Integrator 22 integrates the average amplitude signals $\overline{A}$ generated by the Averaging Circuit 20 and outputs a difference signal Δ indicative of the difference between the integrated average value $\overline{A}_{avg.}$ of the average amplitude signals and the average amplitude signal $\overline{A}$ generated for each cylinder. The difference signal Δ a is then amplified in Amplifier 24 to generate an amplified difference signal Δ A. The amplified difference signal Δ A is averaged in Correction Averaging Circuit 26. A Subtraction Circuit 28 subtracts the output of the Correction Averaging Circuit 26 from the amplified difference signal Δ A output from Amplifier 24 to generate a correction signal Δ Q. The correction signal Δ Q is then summed in Addition Circuit 30 with the fuel delivery signal Q generated by Fuel Control Computer 10 to generate a corrected fuel delivery signal Q+Δ Q correcting the quantity of fuel delivered to each cylinder. The corrected fuel delivery signal Q+Δ Q is operative to equalize the amplitudes of the torque impulses produced by all of the cylinders.

The Digital Period Analyzer 16, such as disclosed in U.S. patent application Ser. No. 187,400 generates a phase angle signal $\phi$ and an amplitude signal A for each torque impulse in response to the instantaneous rotational velocity of the engine's crankshaft or other suitable rotational member of the engine. The Digital Period Analyzer first generates the functions A sin $\phi$ and A cos $\phi$ where A is the amplitude of the torque impulses and $\phi$ is the phase angle of the torque impulses. The Digital Period Analyzer 16 then computes the value of the phase angle $\phi$ and amplitude A in accordance with the equations $$\phi = \arctan\,[A \sin \phi / A \cos \phi]$$

$$A = \sqrt{(A \sin \phi)^2 + (A \cos \phi)^2}$$

Preferably, the phase angle $\phi$ is corrected for changing engine speed engine speed as disclosed in U.S. patent application Ser. No. 399,538 entitled "Phase Angle Detector" (filed July 19, 1982.)

Figure 2:
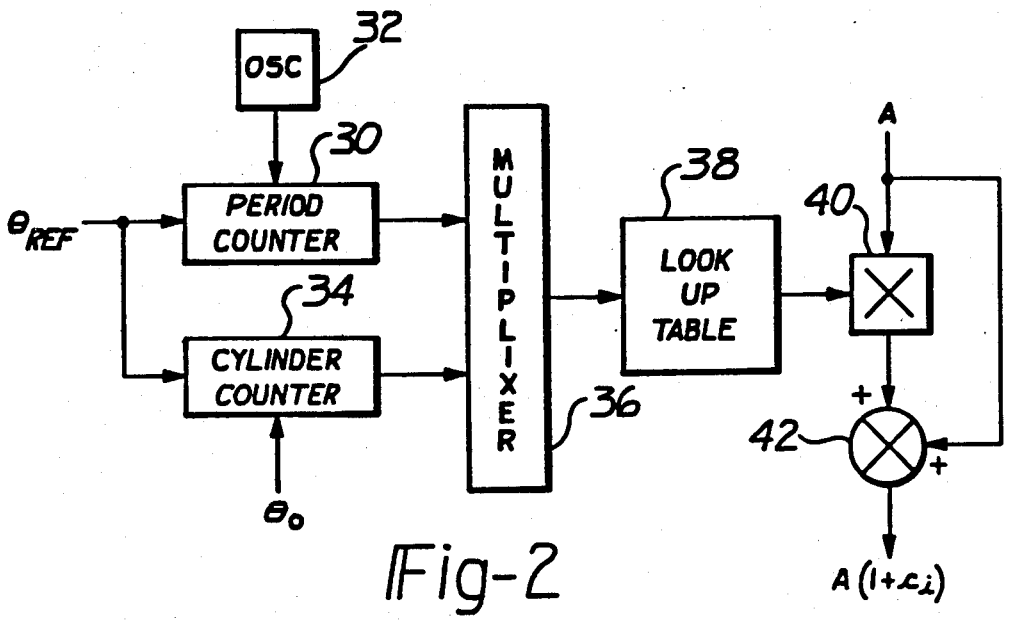
FIG. 2 is a first embodiment of the Amplitude Correction Circuit 18.

The details of the Amplitude Correction Circuit 18 are shown in FIG. 2. As previously discussed, the amplitude of the torque impulse imparted to the engine's crankshaft are distorted by the rotational velocity of the engine's crankshaft, the positions of the individual cylinders along the crankshaft and other torsional vibrations that may occur. Since these distortions differ as a function of engine speed as well as from cylinder to cylinder the Amplitude Correction Circuit 18 may be embodied in the form of a look-up table storing a set of correction factors for each cylinder as a function of engine speed. To reduce the number of stored correction factors for each cylinder, the engine speed may be subdivided into a plurality of discrete speed ranges and the look up table storing a single correction factor for each cylinder for each speed range. The correction factors may be empirically determined from tests or computed from known engine dynamics. Referring back to FIG. 2, a Period Counter 30 is periodically reset by a reference signal $\theta_{REF}$ indicative of the engine's crankshaft rotating through a predetermined angle, such as when the piston in each cylinder assumes a predetermined position. This position may be the Top Dead Center (TDC) or any other selected position. The Period Counter 30 counts the pulses generated by an Oscillator 32 and stores at the end of each rotational interval a number indicative of the time between sequential reference signals. This number is inversely proportional to the engine's rotational velocity in that interval. The frequency of Oscillator 32 is selected so that the engine speed is divided into a predetermined number of speed ranges. Preferably Counter 30 is a variable speed counter as described in U.S. patent application Ser. No. 187,400 which counts at a lower rate when the engine speed is below a predetermined value.

A Cylinder Counter 34 is reset by a reference signal $\theta_o$ indicative of the beginning of each engine cycle. The Cylinder Counter 34 counts the reference signals $\theta_{REF}$ and generates a sequential set of numbers one for each engine cylinder. Each number generated in Cylinder Counter 34 uniquely identifies one of the engine's cylinders.

At the end of each period, signified by the occurrence of the reference signal $\theta_{REF}$ the numbers stored in Period Counter 30 and Cylinder Counter 34 are input to Multiplexer 36 which generates an address identifying a specific storage location in a Look-Up-Table 38. The Look-Up-Table 38 may be a conventional read-only-memory (ROM) or any comparable type memory storing a set of correction factors "$c_i$" for each engine cylinder as a function of engine speed. The address generated by the Multiplexer 36 identifies the cylinder in response to number received from the Cylinder Counter 34 and identifies the specific speed related correction factor for the cylinder in response to the number received from the Period Counter 30.

The correction factor "$c_i$" output from the Look-Up Table 38 is multiplied with the amplitude A generated by the Digital Period Analyzer 16 in a multiplier circuit 40 to produce a correction increment having a value equal to $c_i$A. The amplitude correction is then summed with the amplitude signal A in a sum amplifier 42 to generate a corrected amplitude signal A+$c_i$A corrected for both engine speed and other errors that may have been caused by the particular location of that particular cylinder along the engine's crankshaft. Alternatively the correction factor stored in Look-Up Table 38 may be (1+$c_i$) eliminating the need for sum amplifier 42 as would be obvious to one skilled in the art.

Figure 3:
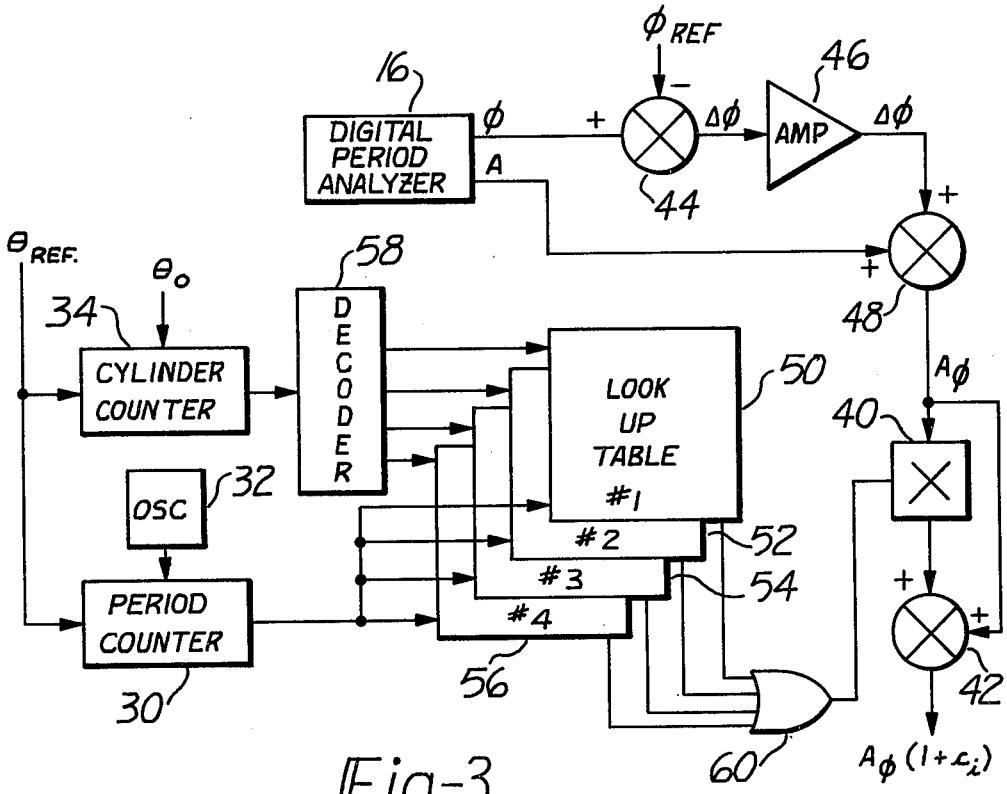
FIG. 3 is an alternate embodiment of the Amplitude Correction Circuit 18.

An alternate embodiment of the amplitude correction circuit is shown on FIG. 3. In this embodiment the phase angle signal $\phi$ is used to correct the amplitude signal A prior to the correction for engine speed and position of the cylinder along the engine's crankshaft. As disclosed Randall and Powell, previously cited, maximum engine efficiency is obtained when the cylinder pressure occurs at a predetermined angle of the crankshaft past the top dead center (TDC) position. Additionally, C. K. Leung and R. W. Seitz in U.S. patent application Ser. No. 187,400 filed on Sept. 15, 1980 have disclosed that the phase angle of the torque impulse is a measure of the angle at which maximum cylinder pressure occurs. Therefore when the phase angle of the torque impulse is different from the phase angle desired to produce maximum efficiency of the engine the amplitude of the torque impulse is less than it would have been had the phase angle been correct. Based on the assumption that the ignition or injection timing is being corrected independently to produce the desired phase angle, the amplitude should be first corrected for the phase angle error.

Referring now to FIG. 3, the phase angle $\phi$ of the torque impulse generated by the Digital Period Analyzer 16 is first compared with a desired or reference phase angle $\phi_{REF}$ in a difference Amplifier 44 to generate a phase angle error signal $\Delta\phi$. The phase angle error signal is then amplified in Amplifier 46 to generate an amplitude correction signal $\Delta\phi$. The amplitude correction signal $\Delta\phi$ is summed in Sum Amplifier 46 with the amplitude signal A output from the Digital Period Analyzer 16 to generate a phase angle corrected amplitude signal $A_\phi$.

Instead of a single Look-Up Table 38 of the embodiment discussed relative to FIG. 2, the alternate embodiment comprises a plurality of Look-Up Tables 50 through 56, each Look-Up Table storing a correction factor $c_i$ or $(1+c_i)$ for engine speed and the position of the cylinder along the engine's crankshaft for a particular engine cylinder. The illustrated embodiment is for a 4 cylinder engine therefore there are 4 separate Look-Up-Tables. For a 6 cylinder engine, there would be 6 Look-Up-Tables etc.

As previously discussed relative to FIG. 2 a Cylinder Counter 34 generates a number indicative of the cylinder which is producing the torque impulse being analyzed in response to the signals $\theta_o$ indicative of the beginning of each engine cycle and $\theta_{REF}$ indicative of the beginning of the torque impulse produced by each successive cylinder. At the beginning of each torque impulse, the number stored in Cylinder Counter 34 indicative of the cylinder which produced the torque impulse is input to a Decoder 58 which produces a signal on one of 4 output lines corresponding to the number received from the Cylinder Counter 34. Each of the four output lines of Decoder 58 are connected to the enable input of one of the four Look-Up-Tables 50 through 56.

Simultaneously the Period Counter 30 generates a number which is inversely proportional to the engine speed in response to the number of pulses generated by Oscillator 32 during sequentially received reference signals $\theta_{REF}$ as previously discussed. The output of Period Counter 30 is used to address all four of the look up tables simultaneously.

The Look-Up-Table enabled by the output from Decoder 58 will output the appropriate correction factor to Multiplier Circuit 40 through OR gate 60. The phase angle corrected amplitude $A_\phi$ is multiplied by the received correction factor in Multiplier Circuit 40, and summed with the phase angle corrected signal $A_\phi$ in Sum Amplifier 42 to generate the corrected amplitude signal having a value:

$$\text{Corrected Amplitude} = A_\phi(1+c_i)$$

where the phase angle corrected amplitude $A_\phi$ is equal to:

$$A_\phi = A + \Delta\phi$$

As noted in the discussion of the first embodiment of the Amplitude Correction Circuit, if the correction factor has the value $(1+c_i)$ Sum Amplifier 42 is not required.

It will be recognized by those skilled in the art that the phase angle correction circuit illustrated with reference to FIG. 3 may also be incorporated in the Amplitude Correction Circuit of FIG. 2.

Figure 4:
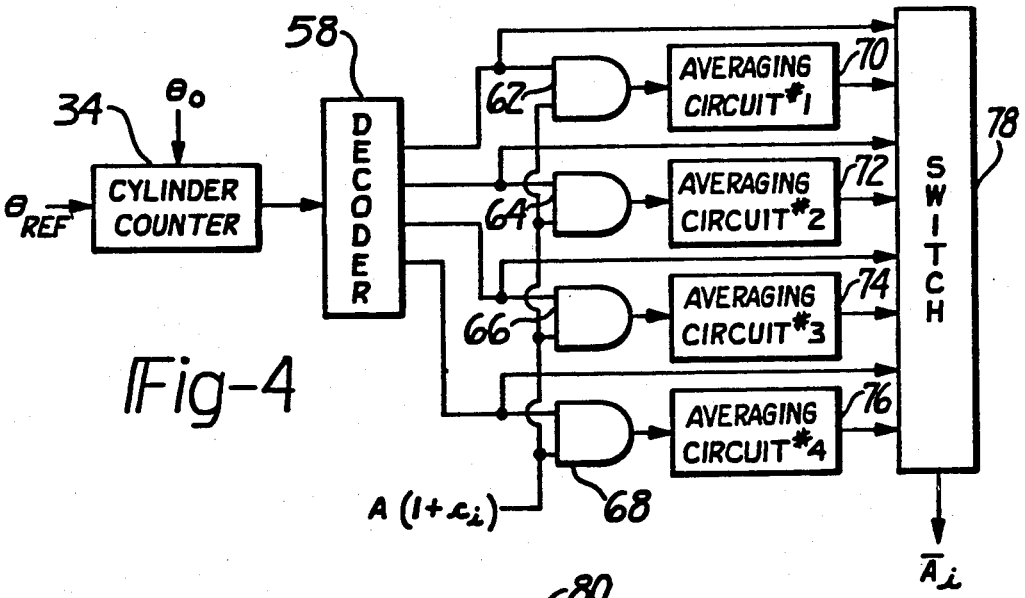
FIG. 4 is an embodiment of the Averaging Circuit 20.

The details of the Averaging Circuit 20 are shown in FIG. 4. As previously discussed the Decoder 58 outputs a signal on four separate lines, one at a time in response to the number stored in Cylinder Counter 34. The Cylinder Counter 34 and Decoder 58 may be the same decoder discussed relative to FIG. 3 or may be separate elements. The output lines of the Decoder 58 are connected to one input of a set of AND gates 62 through 68 which are enabled in a sequential order in response to the output signals of Decoder 58.

The corrected amplitude signal A $(1+c_i)$ generated by the Amplitude Correction Circuit 18 is received at the other inputs to AND gates 62 through 68. The outputs of the AND gates are individually connected to the input of an associated averaging circuit 70 through 78, one for each engine cylinder. As the AND gates 62 through 68 are sequentially enabled by the signals from Decoder 58, the corrected amplitude signals are sequentially input into the associated averaging circuit and averaged with the prior corrected amplitude signals received from the same engine cylinder. The averaging circuits 70 through 76 average the corrected amplitude signals in accordance with the equation:

$$\overline{A}_i = \left(\sum_{j=1}^{N} A_i(1+c_i)_j\right) / N$$

where the subscript "i" designates the particular cylinder. The averaging circuits may be of any type known in the art including the averaging circuit discussed in detail in U.S. patent application Ser. No. 187,400.

The outputs from Decoder 58 along with the outputs from the Averaging Circuits 70 through 76 are connected to a Switch 78 which outputs the averaged amplitude signal $\overline{A}$ from the appropriate averaging circuit in a corresponding sequential order in response to the output of Decoder 58.

Figure 5:
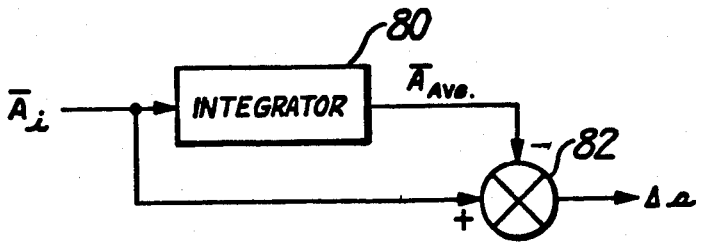
FIG. 5 is an embodiment of the Integrator 22.

The details of the Integrator 22 are shown on FIG. 5. Referring to FIG. 5, the average amplitude signals $\overline{A}_i$ generated in averaging circuits 70 through 78 of FIG. 4 are sequentially received by an integrator 80 which generates an integrated average signal $\overline{A}_{avg.}$ having the value:

$$\overline{A}_{avg.} = \left(\sum_{i=1}^{N} \overline{A}_i l_i\right) / N$$

The average signal $\overline{A}_i$ is then compared with the integrated average signal in difference amplifier 82 to generate the amplitude error signal $\Delta A$. The integrator circuit may be an averaging circuit similar to averaging circuits 70 through 76 or any other circuit known in the art capable of producing an integrated average amplitude signal.

Although the fuel distribution control has been described with reference to specific hard wired circuits, it is recognized that a person skilled in the art is well capable of writing a program for a microprocessor or minicomputer operative to perform the same functions. It is not intended that the invention be limited to the hardwired circuits disclosed. On the contrary the invention may be embodied in any conceivable alternate form including programmed microprocessors or minicomputers without departing from the spirit of the invention as described above and set forth in the appended claims.

What is claimed is:

1. In combination with an internal combustion engine fuel control system including a fuel control computer for generating fuel delivery signals in response to the operational parameters of the engine, means for delivering fuel to the engine in response to the fuel delivery signals, and means for generating amplitude signals indicative of the magnitude of the torque impulses imparted to the engine's crankshaft by the burning of the fuel in the engine's individual cylinders, a fuel distribution control for equalizing the magnitudes of the torque impulse produced by all of the cylinders characterized by:

means for correcting the value of said amplitude signals in response to the rotational velocity and the rotational position of the engine's crankshaft to generate corrected amplitude signals;

first means for averaging said corrected amplitude signals to generate an individual average amplitude signal for each engine cylinder;

means for integrating all of said individual average amplitude signals to generate individual difference signals indicative of the difference between said individual average amplitude signals and the average amplitude for all the cylinders second means for averaging all of said individual difference signals to generate an average difference signal;

first means for subtracting said average difference signal from each of said individual difference signals to generate a fuel correction signal for each cylinder; and means for summing said fuel correction signals to said fuel delivery signals to generate a corrected fuel delivery signal tending to equalize the contribution of each cylinder to the total torque output of the engine.

2. The fuel distribution control of claim 1 wherein said first means for averaging comprises:

decoder means for generating a repetitive set of sequential signals in response to the rotational position of the engine's crankshaft, each signal in said set of signals being indicative of a predetermined operational state of an associated engine cylinder;

a plurality of averaging circuits, one associated with each engine cylinder and individually activated one at a time in response to said set of sequential signals, each averaging circuit averaging said corrected amplitude signals of its associated cylinder to generate said average amplitude signal for its associated engine cylinder; and switch means connected to the outputs of said plurality of averaging circuits for outputting said average amplitude signals one at a time in a predetermined sequence in response to said repetitive set of sequential signals.

3. The fuel distribution control of claim 2 wherein said decoder means comprises:

a cylinder counter responsive to the rotational position of the engine for generating a set of digital numbers, each number corresponding to the cylinder producing the torque impulse; and a decoder responsive to said digital numbers for generating said repetitive set of sequential signals.

4. The fuel distribution control of claims 1 or 2 wherein said means for integrating comprises third means for averaging said average amplitude signals to generate an average of the amplitude signals from all of the cylinders; and second means for subtracting the average of the amplitude signals from all of the cylinders from the individual cylinder average amplitude signals received from said first means for averaging to generate first difference signals indicative of the difference between the individual cylinder average amplitude signals and the average of the amplitude signals from all of the cylinders.

5. The fuel distribution control of claim 4 wherein said means for integrating further includes amplifier means for amplifying said first difference signals to generate amplified first difference signals.

6. The fuel distribution control of claims 1 or 2 wherein said means for correcting the value of said amplitude comprises:

means for generating a first digital number indicative of the rotational velocity of the engine's crankshaft;

means for generating a second digital number indicative of the cylinder currently generating a torque impulse in response to the rotational position of the engine's crankshaft;

means for multiplexing said first and second digital numbers to generate look-up table address corresponding to the cylinder and engine speed identified by said first and second digital numbers;

look-up table means for storing a plurality of amplitude correction factors for each cylinder as a function of engine speed, said look-up table means responsive to said look-up up table address to output the correction factor associated with the cylinder and engine speed identified by said look-up table address; and means for combining said amplitude signal with the correction factor output from the look-up table to generate said corrected amplitude signal.

7. The fuel distribution control of claim 6 wherein means for combining comprise:

multiplier means for multiplying said amplitude signal with said correction factor to generate a correction increment; and means for adding said correction increment to said amplitude signal to generate said corrected amplitude signal.

8. The fuel distribution control of claim 1 wherein said means for correcting the value of said amplitude signal comprises:

decoder means for generating a repetitive set of sequential signals in response to the rotational position of the engine's crankshaft, each signal in said set of signals corresponding to a predetermined operational state of an associated engine cylinder;

means for generating a third digital number indicative of the rotational velocity of the engine's crankshaft;

a plurality of look-up tables, one associated with each engine cylinder for storing a plurality of correction factors for its associated cylinder as a function of engine speed, said look-up tables simultaneously address by said third digital number and enabled in a repetitive sequential order, one at a time in response to said repetitive set of sequential signals to output the correction factor stored in the enabled look-up tables and the address corresponding to said third digital number; and means for combining said amplitude signal with the correction factor output from the enabled look-up table to generate said corrected amplitude signal.

9. The fuel distribution control of claim 2 wherein said means for correcting the value of said amplitude signal comprises:

means for generating a fourth digital number indicative of the rotational velocity of the engine's crankshaft.

a plurality of look-up tables, one associated with each engine cylinder, for storing a plurality of correction factors for its associated cylinder as a function of engine speed, said look-up tables simultaneously addressed by said fourth digital number and enabled in a repetitive sequential order, one at a time in response to said repetitive set of sequential signals to output the correction factor stored in the enabled look-up table and the address corresponding to said fourth digital number; and means for combining said amplitude signals with the correction factor output from the enabled look-up table to generate said corrected amplitude signal.

10. The fuel distribution control of claims 8 or 9 wherein said means for combining comprises:

means for multiplying said amplitude signal with the output correction factor to generate a correction increment; and means for adding said correction increment to said amplitude signal to generate said corrected amplitude signal.

11. The fuel distribution control of claims 1 or 6 wherein said engine fuel control system further includes means for generating a phase angle signal indicative of the crankshaft angle measured from predetermined crankshaft positions where maximum cylinder pressure occurs, said means for correcting said amplitude signals further includes means for correcting said amplitude signals in response to the difference between the generated phase angle signal and a reference phase angle.

12. The fuel distribution control of claims 8 or 9 wherein said engine fuel control system further includes means for generating a phase angle signal indicative of the crankshaft angle measured from predetermined crankshaft positions where maximum cylinder pressure occurs, said means for correcting said amplitude signals further includes means for correcting said amplitude signals in response to the difference between said generated phase angle and a reference phase angle.

13. The fuel distribution control of claim 12 wherein said included means for correcting comprises:

differential amplifier means for generating a phase angle error signal corresponding to the difference between the generated phase angle signal and said reference phase angle signal; and means for summing said phase angle error signal with said amplitude signal to correct the value of said amplitude signals for phase angle errors.

14. A method for controlling the quantity of fuel supplied to each cylinder is an internal combustion engine having means for generating fuel delivery signals in response to at least one operational parameter of the engine, means for delivering fuel to the engine in response to the fuel delivery signals, and means for generating amplitude signals indicative of the magnitude of the impulses imparted to the engine's crankshaft as a result of burning the fuel in the engine's individual cylinders, said method comprising the steps of:

correcting the value of said amplitude signals in response to the rotational velocity and rotational position of the engine's crankshaft to generate corrected amplitude signals for torque impulses produced by each cylinder on an individual basis;

averaging said corrected amplitude signals to generate an average amplitude signal for each cylinder;

averaging all of said average amplitude signals for each cylinder to generate an average amplitude signal for all of the cylinders;

subtracting the average amplitude signal for all of the cylinders from the average amplitude signal for each cylinder in a predetermined sequence to generate difference signals for each cylinder;

averaging said difference signals to generate an average difference signal;

subtracting said average difference signal from said difference signals for each cylinder to generate a fuel correction signal; and summing said fuel correction signals with said fuel delivery signals to individually correct the quantity of fuel delivered to the engine's cylinders tending to equalize the contribution of each cylinder to the total torque output of the engine cylinder.

15. The method of claim 14 wherein said step of correcting the value of said amplitude signals comprises the steps of:

storing in a look-up table a plurality of correction factors for each cylinder as a function of engine speed.

generating a cylinder signal indicative of the cylinder that produced the torque impulse in response to the rotational position of the crankshaft;

generating a speed signal indicative of the rotational velocity of the engine's crankshaft;

multiplexing said cylinder signal with said speed signal to generate a look-up table address containing the correction factor for the identified cylinder at the identified engine speed;

addressing said look-up table with said address to output the stored correction factor; and combining said correction factor with said amplitude signal to generate said corrected amplitude signal.

16. The method of claim 14 wherein said step of correcting the value of said amplitude signals comprises the steps of:

storing in each of a plurality of look-up tables, one associated with each cylinder, a plurality of correction factors for the associated cylinder as a function of engine speed;

generating a speed signal indicative of the engine's speed in response to a signal indicative of the rotational velocity of the engine's crankshaft;

generating a cylinder signal indicative of the cylinder that produced the torque impulse in response to the rotational position of the engine's crankshaft enabling said look-up tables with said cylinder signals one at a time to output the correction factor addressed by said speed signal; and combining said correction factors output from said plurality of look-up tables with said amplitude signals to generate said corrected amplitude signals.

17. The method of claims 15 or 16 wherein said step of combining comprises the steps of:

multiplying said amplitude signals by said correction factor to generate an incremental correction; and adding said incremental correction to said amplitude signal to generate said corrected amplitude signal.

18. The method of claims 15 or 16 wherein said means for generating amplitude signals further includes means for generating a phase angle signal having a value indicative of the crankshaft angle relative to fixed angular positions were maximum cylinder pressure occurs, said step of correcting the value of the amplitude signals further includes the step of first correcting the value of the amplitude signal as a function of the difference between the generated phase angle signal and a reference phase angle signal.

19. A fuel control system for an internal combustion engine having at least one fuel delivery device for delivering fuel to the engine in response to electrical fuel delivery signals comprising:

fuel control computer means for generating fuel delivery signals in response to at least one operational parameters of the engine;

means for generating amplitude signals in response to the instantaneous rotational velocity of the engine's crankshaft, said amplitude signals indicative of the magnitude of the torque impulses imparted to the engine's crankshaft by the burning of fuel in the engine's individual cylinders;

means for correcting the value of said amplitude signals in response to the rotational position of the engine's crankshaft and engine speed to generate corrected amplitude signals;

means for averaging said corrected amplitude signals to generate an individual average amplitude signal for each engine cylinder;

means for integrating said individual average amplitude signals to generate individual difference signals indicative of the difference between said individual average amplitude signals for each cylinder and an average amplitude signal for all of the cylinders;

means for averaging said individual difference signals to generate an average difference signal;

means for subtracting said average difference signal from the individual difference signals to generate a correction signal; and means for combining said correction signal with said fuel delivery signal to generate a corrected fuel delivery signal enabling said at least one fuel delivery device to deliver a quantity of fuel to each engine operative to equalize the torque contribution of each cylinder to the total torque output of the engine.

20. The fuel control system of claim 19 wherein said means for generating amplitude signals further includes means for generating phase angle signals indicative of the phase angle of said torque impulses measured from predetermined angular positions of the engine's crankshaft, said fuel control system further includes means for correcting the value of said amplitude signals as a function of the difference between said phase angle signals and a reference phase angle to generate phase angle corrected amplitude signals.

21. A method for equalizing the contribution of each cylinder in an internal combustion engine to total torque output of the engine comprising the steps of:

detecting at least one operational parameter of the engine to generate fuel delivery signals indicative of the engine's fuel requirements;

detecting a moving member of the engine indicative of the instantaneous rotational velocity of the engine's crankshaft to generate amplitude signals indicative of the magnitude of the torque impulses imparted to the engine's crankshaft by the burning of fuel in the individual cylinders;

adding predetermined correction factors to said amplitude signals to generate corrected amplitude signals in response to detecting predetermined rotational positions of the engine's crankshaft, said predetermined correction factors correcting said amplitude signals for the position of the cylinder which produced the torque impulse along the crankshaft and engine speed;

averaging said corrected amplitude to generate an individual average amplitude signal for each cylinder;

integrating said individual average amplitude signals to generate individual difference signals for each cylinder, said individual difference signals indicative of the difference between said individual average amplitude signals and an average amplitude signal for all of the cylinders;

averaging said individual difference signals to generate an average difference signal;

subtracting said average difference signal from said individual difference signals to generate a correction signal; and summing said correction signal with said fuel delivery signal to generated a corrected fuel delivery signal enabling said at least one fuel delivery device to deliver a quantity of fuel to each engine cylinder operative to equalize the contribution of each cylinder to the total torque output of the engine.

22. The method of claim 21 wherein said step of detecting a moving member to generate amplitude signals further includes the step of generating phase angle signals indicative of the phase angle of said torque impulses measured from predetermined angular positions of the engine's crankshaft, said method further including the step of correcting the value of said amplitude signals as a function of the difference between said phase angle signals and a reference phase angle to generate phase angle corrected amplitude signals.

* * * * *